United States Patent [19]

Murphy et al.

[11] Patent Number: 4,790,916

[45] Date of Patent: Dec. 13, 1988

[54] ONE-UNIT PHOTO-ACTIVATED ELECTROLYZER

[75] Inventors: Oliver J. Murphy; John O'M Bockris, both of College Station, Tex.

[73] Assignee: The Texas A&M University System, College Station, Tex.

[21] Appl. No.: 86,561

[22] Filed: Aug. 18, 1987

Related U.S. Application Data

[62] Division of Ser. No. 4,722,776, Feb. 2, 1988.

[51] Int. Cl.[4] ..... C25B 1/02; C25B 15/00; H01M 6/36

[52] U.S. Cl. ..... 204/129; 429/111; 204/242

[58] Field of Search ..... 204/129, 228, 242; 429/111

[56] References Cited

U.S. PATENT DOCUMENTS

| | | | |
|---|---|---|---|
| 3,925,212 | 12/1975 | Tchernev | 250/527 |
| 3,989,542 | 11/1976 | Clark | 136/89 |
| 4,021,323 | 5/1977 | Kilby et al. | 204/129 |
| 4,037,029 | 7/1977 | Anderson | 429/111 |
| 4,061,555 | 12/1977 | Miyatani et al. | 204/242 |
| 4,094,751 | 6/1978 | Nozik | 204/80 |
| 4,119,768 | 10/1978 | Bayard | 429/111 |
| 4,124,464 | 11/1978 | Miyatani et al. | 204/129 |
| 4,128,704 | 12/1978 | McKinzie et al. | 429/111 |
| 4,136,436 | 1/1979 | Kilby et al. | 29/572 |
| 4,160,816 | 7/1979 | Williams et al. | 423/648 |
| 4,173,494 | 11/1979 | Johnson et al. | 136/89 |
| 4,182,662 | 1/1980 | Hart | 204/101 |
| 4,203,814 | 5/1980 | Grantham | 204/129 |
| 4,215,182 | 7/1980 | Ang et al. | 429/15 |
| 4,236,984 | 12/1980 | Grantham | 204/129 |
| 4,246,080 | 1/1981 | Shinn | 204/129 |
| 4,263,111 | 4/1981 | Hooper et al. | 204/129 |
| 4,278,831 | 7/1981 | Riemer et al. | 136/256 |
| 4,315,973 | 2/1982 | Manassen et al. | 429/111 |
| 4,320,154 | 3/1982 | Biter | 427/75 |
| 4,341,607 | 7/1982 | Tison | 204/129 |
| 4,352,722 | 10/1982 | Ohkawa | 204/278 X |
| 4,381,233 | 4/1983 | Adachi et al. | 204/242 |
| 4,381,978 | 5/1983 | Gratzel et al. | 204/75 |
| 4,392,297 | 7/1983 | Little | 29/572 |
| 4,416,052 | 11/1983 | Stern | 29/572 |
| 4,427,749 | 1/1984 | Graetzel et al. | 204/242 X |
| 4,466,869 | 8/1984 | Ayers | 204/157.1 |
| 4,521,499 | 6/1985 | Switzer | 429/111 |
| 4,525,435 | 6/1985 | Yamazaki | 429/111 |
| 4,525,437 | 6/1985 | Yamazaki | 429/111 |
| 4,565,617 | 1/1986 | Ahuja | 204/229 |
| 4,595,568 | 6/1986 | Van Damme et al. | 204/129 X |

OTHER PUBLICATIONS

Nozik, Applied Physics Letters, 29:150–153 (1976).
Ohashi et al., Energy Research, 1:259–277 (1977).
Kautek et al., Ber. Bunsenges. Phys. Chem., 84:1034–1040 (1980).
Heller et al., Physical Review Letters, 46:1153–1156 (1981).
Dahlberg, Inc. J. of Hydrogen Energy, 7:121–142 (1982).
Dominey et al., J. Am. Chem. Soc., 104:467–482 (1982).
Hanson et al., Int. J. of Hydrogen Energy, 7:3–20 (1982).
Bockris et al., Applied Physics Communications, 2:295–299 (1982–83).
Szklarczyk et al., Applied Physics Letters, 42:1035–36 (1983).
Heller, Science, 223:1141–1148 (1984).

*Primary Examiner*—Donald R. Valentine
*Attorney, Agent, or Firm*—Arnold, White & Durkee

[57] ABSTRACT

A photo-activated semiconductor device is adapted to be exposed to light energy. Two physically separated electrocatalysts are placed in electrical contact with the photo-activated semiconductor device. An electrolytic solution physically separated from the semiconductor device is placed in electrical contact with both electrocatalysts. A method for supplying electrical energy to an anode and a cathode is an electrochemical reaction zone containing an electrolytic solution which comprises positioning a photo-activated semiconductor device having separate donor and acceptor regions external to an electrolytic solution. The doner region is electrically connected to a cathode and the acceptor region is electrically connected to the anode. A portion of the photo-activated semiconductor device is exposed to a source of radiation which is external to the reaction zone. The products derived from the electrolytic solution are collected for later use.

4 Claims, 3 Drawing Sheets

ONE-UNIT PHOTO-ACTIVATED ELECTROLYZER

This is a division of U.S. Pat. No. 4,722,776 issued on Feb. 2, 1988.

BACKGROUND OF THE INVENTION

The present invention relates generally to the energy conversion of sources of radiation, such as light. Specifically, the present invention provides a unique highly-efficient device and method for photoelectrolysis and artificial photosynthesis which needs no outside electrical energy source.

Electrolysis of various aqueous solutions to produce hydrogen, chlorine, bromine and the like, or to deposit various metals, has been known for many years. Generally, however, external sources of electrical energy are required for the process. Thus, prior methods of electrolysis are costly and inefficient due to the use of electrical energy which in most cases is produced by technologies involving a Carnot cycle.

The problem of high cost and low efficiency creates the need for an alternative non-carnot based extensive source of electrical energy. This problem can be solved by using light energy to decrease the need for expensive Carnot based external electricity, or to avoid the need completely. At present, four related light-based systems, having distinctive features, are possible. These are: (i) photovoltaic array and a separate water electrolyzer, giving rise to two plants; (ii) colloidal semiconductor systems which operate on solar energy alone as input; (iii) photo-aided electrolysis, necessitating both solar and electrical energies as inputs; and (iv) photoelectrolysis, requiring only solar energy as input.

The photovoltaic array system consists of a photoactivated semiconductor device, typically single crystal silicon, which when irradiated, produces an electric current. The current is applied to a conventional water electrolyzer. The need to connect several of the photovoltaic cells in series to obtain sufficient voltages for many electrochemical applications, increases the requirement for space and the cost of materials. In addition, a defective cell or broken electrical contact in such systems leads to significant energy losses. As a consequence, manufacturing standards and costs are raised.

Colloidal semiconductor systems consist of electrocatalyst coated submicron semiconductor particles suspended in an electrolyte solution and which operates on solar energy as input.

In photo-aided electrolysis systems either a p-type or n-type semiconductor electrode coupled to a metal oxide electrode and the like, or a p-type semiconductor electrode coupled to an n-type semiconductor elctrode, are immersed in an aqueous solution and the semconductor materials irradiated with light at the semiconductor/solution interface. However, an external source of electrical energy is needed in addition to light energy to drive the desired reaction. Thus, although the need for external electrical energy is reduced, the costly use of external electrical energy makes the devices less efficient than desired.

Photoelectrolysis is a system similar to photo-aided electrolysis except that no external electrical energy is required to drive the reaction. Photoelectrolysis systems, however, are typically limited in their application because of the relatively low solar energy conversion efficiencies currently obtainable.

Colloidal, photoelectrolysis and photo-aided electrolysis systems suffer from several disadvantages, including damage and inefficiency resulting from immersing semiconductors in the electrolyte, inefficient use of space and inefficient use of materials.

When semiconductors are immersed in the electrolyte, damaging photocorrosion or photopassivation phenomena generally results from interaction of the semiconductors with the intermediates and/or the products of electrochemical reactions. Of particular concern is the problem of hydrogen embrittlement where one of the electrochemical reactions involves hydrogen evolution. Hydrogen embrittlement involves the diffusion of adsorbed hydrogen species into the bulk of the semiconductor materials giving rise to localized highly stressed regions which promotes cracking and breakdown of the semiconductor material.

Efforts are generally made to protect semiconductors from these damaging interactions by coating the semiconductors with extremely thin layers of materials. The coatings are extremely thin in order to allow light to pass through to the semiconductor. The maximum thickness suitable for allowing sufficient light transmission is on the order of 40–100 angstroms. Typically the material coated on the semiconductor is a suitable catalyst for the particular electrochemical reaction desired. Unfortunately, because of their extremely thin nature these catalysts are also damaged and worn through photocorrosion. Additionally, the thin electrocatalyst layers generally have small pin-sized holes which allows the electrolyte to contact the semiconductor material. As a result, the protection afforded to semiconductors by these coatings are short lived, and the catalytic activity rapidly reduced. Accordingly, to avoid damage to semiconductors, and to maintain the electrical efficiency of the system, frequent replacement of typically expensive catalyst layers is required. However, frequent replacement of catalysts in industrial or household installations is impractical.

Immersing semiconductors in the electrolyte creates still other disadvantages. Since the electrical current created by the semiconductors is dependent upon the intensity of the light which reaches the semiconductors, any barriers to light transmission reduces the efficiency of the system. Light is in part reflected at the boundary between two transparent media, thereby reducing its intensity. This is the case in known light activated electrolysis devices, where light must pass through an aqueous electrolyte solution, and generally through a transparent catalyst layer before reaching the semiconductor. Light is lost due to reflection by the transparent material housing the semiconductor and the electrolyte, the electrolyte, the semitransparent catalyst, and in part by the semiconductor surface itself. In addition, light photons are absorbed by the electrolyte, further reducing the light intensity reaching the semiconductor. If the device can only generate sufficient voltage to split hydrogen bromide, the electrolyte solution may become colored as a result of the electrochemical oxidation of bromide ions thereby further decreasing light transmission.

In applications for producing hydrogen, the disadvantages of the above described devices have resulted in extremely low efficiencies of solar energy conversion to hydrogen, generally on the order of 1%. Moreover, for the efficient production of hydrogen, solutions have been limited to solutions containing hydrogen bromide because of the relatively low voltages supplied by previously known devices. Although only relatively small and easily obtainable voltages are required for the electrolysis of HBr, the bromine gas produced is an undesirable by-product of the reaction. Similarly in the case of the electrolysis of chloride-containing solutions the chlroine gas produced is an undesirable by-product as well. Because of their poisonous nature, these gases pose a potential hazard. In addition, these systems are generally closed, i.e., the hydrogen and bromine must be recombined in a fuel cell to give back the original hydrogen bromide, which can then be re-used as the electrolyte. A distinct disadvantage of the colloidal system is that evolved gases cannot be separated. If hydrogen and oxygen are evolved, dangerous explosive conditions may result. However, hydrogen is a highly desirable fuel in itself as well as a valuable chemical feedstock for the production of ammonia, methanol, synfuels and the like. Hydrogen removed from a cell may be stored for later use in a fuel cell, for use in an internal combustion engine or for industrial or household functions, such as heating, cooling or cooking.

For the above reasons, the electrolysis of water is highly desirable. Among other things, oxygen is easily vented to the atmosphere, thereby providing a beneficial effect. Working against these advantages, however, is the fact that known electrolysis devices which require no external sources of electricity, need at least four photo-activated semiconductor cells in series to produce sufficient voltage for the practical electrolysis of water (cell as used here means a semiconductor having n and p material). This results in the inefficient use of materials, space and available light energy.

A feature of the present invention is its ability to correct the inefficiencies encountered with previously known electrolysis devices. The semiconductor material is external to the electrolyte solution, thereby avoiding the problem of photocorrosion. Further, since the semiconductor material is external to the electrolyte, full advantage of available light energy may be obtained since light intensity is not decreased by semitransparent or translucent barriers. Catalysts, in addition, may be thicker since light need not pass through the catalysts to reach the semiconductor material. Consequently, the catalysts provide greater protection to underlying material as well as provide the extended catalytic activity required for a practical operating device. Another feature of the present invention is that by coupling the above gained advantages to the use of photo-activated semiconductors of suitable voltage output, the desirable advantage of electrolyzing water may be obtained using fewer semiconductors than previously required which results in the need for less space and maximizes the use of available light energy.

SUMMARY OF THE INVENTION

The present invention discloses an improved system of converting light energy to useful electrical and chemical energy. A photo-activated semiconductor device comprising one or more photo-activated semiconductors is directly exposed to light physically external of an electrolyte, thus avoiding photocorrosion damage to the semiconductor material as well as light transmission losses through the electrolyte and any barriers imposed by an electrocatalyst. The electrocatalysts are placed in electrical contact with the photo-activated semiconductor device. These electrocatalysts in turn are placed in direct electrical contact with the electrolyte solution, thus shielding the semiconductor material from the electrolyte. Because light does not pass through the electrocatalysts, the electrocatalysts may be of an indefinite thickness, thus providing increased semiconductor material protection, and longer catalytic activity. Upon direct exposure to light, the photoactivated semiconductor device creates a potential which causes current to flow through the electrocatalyst and through the electrolyte thereby producing useful electrical and chemical energy.

BRIEF DESCRIPTION OF THE DRAWINGS

The described figures are for use with the following detailed description of the preferred embodiments. Those skilled in the art will readily appreciate modifications and changes in the figures and descriptions set forth without departing from the spirit and scope of the invention.

DETAILED DESCRIPTION OF THE PREFERRED EMBODIMENTS

The subject invention uses high-voltage output photovoltaic cells in a unique manner to produce electrical current which in turn drives an electrochemical reaction with much greater efficiency than previously known.

Figure 1:
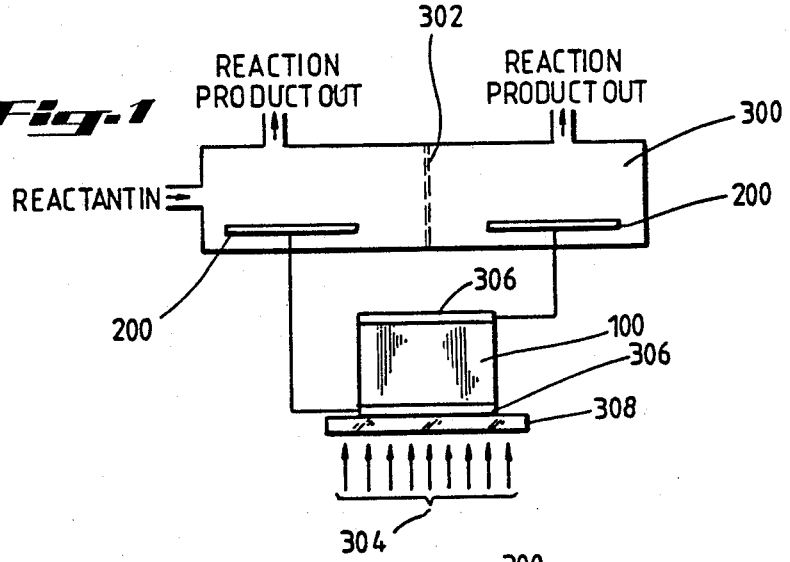
FIG. 1 is a schematic diagram depicting the general invention.

FIG. 1 is a generalized schematic diagram of the photo-activated electrolytic apparatus of the present invention. A photo-activated semiconductor device 100 is placed in electrical contact with separate electrocatalysts 200. An ohmic contact layer 306 is interposed between the electrocatalysts 200 and the semiconductor assemblage 100. A glass sheet 308 is placed on the surface of the semiconductor 100 which is exposed to light 304. The electrocatalysts 200 are in electrical communication through an electrolyte 300.

The photo-activated semiconductor device 100 preferably uses high-voltage output photo-activated cells. The only high-voltage output cells available at the present time are gallium arsenide photovoltaic cells, both single crystal and polycrystalline based, as well as amorphous silicon cells. However, the use of other suitable photo-activated semiconductors as they become known is acceptable to practice the present invention.

In the case of semiconductor devices consisting of amorphous silicon, various structures may be employed. The simplest of these is a single cell structure, which is called a pin cell. Other structures would include a two-stacked cell (pin-pin) or a three-stacked cell (pin-pin-pin). These stacks of pin cells may be electrically connected in series within the stack structure or to adjacent stacks. For example, a two-stacked cell (pin-pin) may be used with another two-stacked cell (pin-pin) producing a (pin-pin)-(pin-pin) cell. Similarly, three-stacked cells may be used with other three-stacked cells, (pin-pin-pin)-(pin-pin-pin), two-stacked cells, (pin-pin-pin)-(pin-pin), a single cell, (pin-pin-pin)-(pin) or on its own (pin-pin-pin). Other variations are suitable as well. The individual amorphous silicon cells are so thin that the light can penetrate through a complete stack of cells, each cell absorbing a certain portion of energy from the solar spectrum.

In the case of a gallium arsenide photo-activated semiconductor device, two gallium arsenide semiconductor cell structures, (an n/p and a p/n connected in series), have been used in the device. In this case, the light strikes both cells simultaneously to send electrical current through the electrolyte. Hence, such an approach can be described as being a two photon per electron process and is a measure of efficient use of light energy. A photon is a bundle of solar energy. A photon possesses a definite amount of energy given by the expression, $E=(h)(v)$, where E is energy, h is Planck's constant, and v is the frequency. The same applies in the case of a double stacked amorphous silicon cell structure, e.g., a (pin-pin)-(pin-pin) structure. This type of device is also a two photon per electron device. Similarly, a (pin)-(pin) arrangement would be a two photon per electron device. This latter device is the one where, by means of optimization of the temperature of the electrolyte and maximization of the amount of electrocatalyst used, an efficient amorphous silicon-based electrolyzer can be constructed. In the case of the three-stacked amorphous silicon photovoltaic cell structure (pin-pin-pin), the photovoltaic electrolyzer constructed from it would be a one photon per electron device.

The present invention is especially desirable for the electrolysis of water into hydrogen and oxygen. A typical electrolysis cell voltage in the case of water splitting at practical rates of hydrogen production is approximately 2 V. The minimum potential required is 1.23 V. However, water electrolysis at the minimum potential, although thermodynamically possible, is impractical for an operating device since the evolution of oxygen is kinetically very slow. Thus, an overpotential of about 0.8 V is required to make the system kinetically efficient. This is why previous devices using two photons per electron have been limited to the electrolysis of HBr and the like. HBr has a minimum thermodynamic potential of about 0.8 V. But bromine evolution is kinetically much faster than oxygen evolution and thereby requires little overpotential for a kinetically efficient system. Consequently, to obtain the advantages of water electrolysis has required at least four photons per electron in previous devices. The present invention can easily obtain the necessary voltages required for water electrolysis using one photon per electron and two photons per electron photo-activated semiconductor devices, thus maximizing the use of available light energy while minimizing the amount of space needed.

The two gallium arsenide cells produce voltages up to 2.0 V. An amorphous silicon photovoltaic cell arrangement of the (pin-pin) type creates a potential of 1.5 V, while the (pin-pin)-(pin-pin) arrangement can create a potential of up to 3.0 V.

Especially desirable would be a single three-stacked arrangement of the (pin-pin-pin) type. This one photon per electron arrangement is capable of providing enough voltage for splitting water on its own. This arrangement provides up to 2.2 V.

In addition to splitting water into its gaseous products hydrogen and oxygen, the device can be utilized for a variety of electo-organic synthesis, for example, Kolbe reactions or Hoefer-Moest reactions, as well as, electro-inorganic synthesis, such as, the formation of chlorine gas, sodium hydroxide and sodium persulphate. In some of these cases, in particular in the case of electro-organic synthesis, the reactants may have to be placed in the electrochemical reaction zone in addition to the electrolyte and the solvent, that is, the electrolyic solution.

Light energy is further maximized in the case of stacked amorphous silicon arrangements because the opportunity to use available energy from the whole solar spectrum is increased. As light photons pass through the photo-activated semiconductor stack, it may interact with the first semiconductor material which excites electrons thereby creating a potential. However, some photons of different energy may interact with a second or third photo-activated semiconductor thereby creating additional potential. Further, some photons may pass through a semiconductor without interacting. In a stacked arrangement the chances for positive photon and semiconductor interaction with at least one semiconductor in the stack is increased.

The electrocatalysts 200 employed in the present invention may be any suitable electrocatalyst desired. These include, but are not limited to, ruthenium dioxide, irridium dioxide, platinum, lanthanum nickelate, nickel cobaltate, nickel, cobalt or nickel molybdate. The electrocatalyst is chosen for the particular electrochemical reduction or oxidation reaction occurring at the respective cathode or anode site. In the present invention, the electrocatalysts are connected to the ohmic contact layer 306 on the surfaces of the photo-activated semiconductor material.

Since the light does not pass through the electrocatalysts, the electrocatalysts or the electrocatalysts plus the substrate supports can be of indefinite thickness. This is important with regard to the lifetime of such devices, as well as the amount of protection rendered to semiconductor materials.

The ohmic contact layers serve as a means for electrically connecting individual photo-activated semiconductor material. The ohmic contact layers may be of any material of suitable conductivity which gives rise to the desired ohmic contact rather than a rectifying contact. In the case of stacked arrangements, ohmic contact layers between individual semiconductors may not be necessary as in the case of stacked arrangements of amorphous silicon semiconductors. In addition, other suitable means of interconnecting semiconductors may be employed without departing from the spirit of the invention.

In the case of amorphous silicon photo-activated devices the glass serves primarily as a support for the underlying thin ohmic contact layer and successive amorphous silicon layers. In addition, it offers protection to the underlying materials as well. The glass may not be required for the device if support is furnished in another manner. Further, any transparent material may be suitable, for example, plastics.

Since electrical conduction in solution is ionic, an electrolyte(s) is used. Suitable electrolyes include, but are not limited to, sulfuric acid, sodium hydroxide, potassium hydroxide, sodium sulfate, sodium perchlorate and the like. Further, various concentrations of these electrolytes can be used.

In a practical operating device a membrane interposed between the electrocatalysts would be used to separate evolved gases. Suitable membranes would be those which would be permeable to ions to conduct electricity, yet non-permeable to the evolved gases. Examples of such membranes would be membranes of asbestos-based substances or Nafion-based plastics (Nafion is a product of DuPont).

Figure 2:
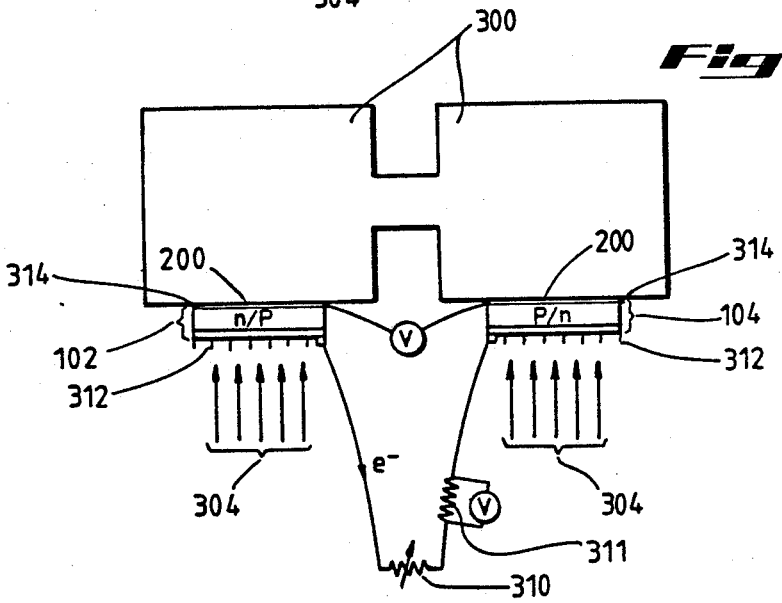
FIG. 2 is a diagrammatic sketch of a one-unit photo-activated electrolyzer.

FIG. 2 is a diagrammatic sketch of a preferred embodiment of the present invention. In this particular embodiment an n/p gallium arsenide semiconductor 102 is connected in series with a p/n gallium arsenide semiconductor 104. An ohmic contact grid 312 is placed in contact with the surfaces of the semiconductors 102 and 104 directly exposed to light. Electrocatalysts 200 are applied to an ohmic contact layer 314 which in turn is applied to other unexposed surfaces of the semiconductor assemblages 102 and 104 of the opposite conductivity type. An electrolyte 300 is then placed into electrical contact with the electrocatalysts 200. For purposes of producing the graph in FIG. 3, a load resistor 310 was placed in the circuit depicted in FIG. 2. In the case of a practical operating system for producing hydrogen, this external load would not normally be installed, and the system would function at zero load potential. The zero load potential corresponds to the maximum hydrogen production rate from water.

The ohmic contact grid 312 covers only a few percent of the gallium arsenide semiconductors, giving maximum access to light photons. The ohmic contact grid and the ohmic contact layer serve to collect the photo-generated charge carriers arriving at the surface of the semiconductor material.

Figure 3:
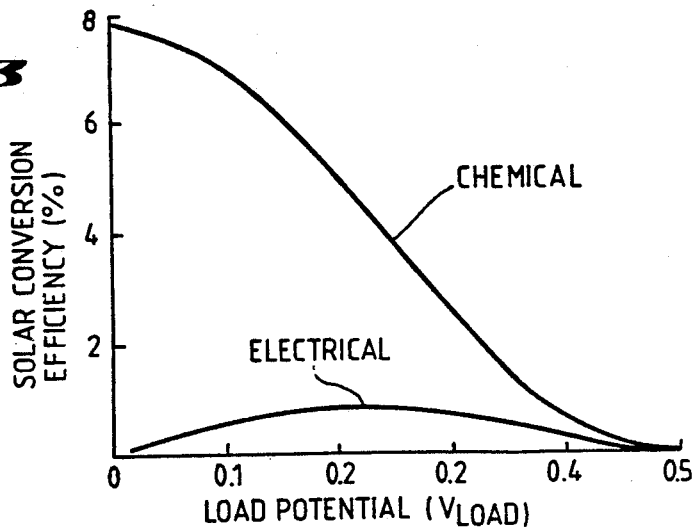
FIG. 3 is a graph referring to a particular embodiment of FIG. 2 and represents the variation of solar conversion efficiency to hydrogen as a function of load potential drop.

FIG. 3 presents data obtained from the specific embodiment of the system illustrated in FIG. 2. The p/n-GaAs junction was covered with a platinum foil electrocatalyst and the n/p-GaAs junction with a titanium/ruthenium dioxide electrocatalyst. The electrocatalyst materials are attached to the ohmic contact layers on the dark GaAs surfaces (as received) by means of conducting silver-filled epoxy [Resin or cement] (E-Solder No. 3021, Acme Chemicals, Connecticut, U.S.A.) Although the electrocatalysts were attached to the ohmic metal contacts at the back of the photovoltaic cells by means of conducting silver-filled epoxy, in the case of the present illustration, these could be attached by a number of well-known methods, such as electrodeposition, chemical vapor deposition, sputtering, plasma spraying or thermal decomposition methods. The area of the GaAs semiconductors and electrodes was 1 square centimeters for the n/p and 4 square centimeters for the p/n. The electrocatalyst-coated semiconductors were mounted on polyethylene holders by means of epoxy cement (E-POX-E5, Loctite Corp., Cleveland, Ohio 44128, U.S.A.), the holders were capable of being fitted into ground glass joints in the cell wall, exposing only the electrocatalyst layers to the solution. Prior to irradiation, the electrolyte in the cell (5 M sulfuric acid) was flushed with pure nitrogen gas for 30 min. Irradiation was achieved by means of a solar simulator (Oriel, model 6730/6742), fixed with an Air Mass One filter. Light intensities were measured using a standardized Eppley precision pyranometer, model PSP (Eppley Laboratory, Rhode Island, U.S.A.).

The photocurrent was recorded as a potential drop across a standard resistor 311. (Central Scientific Co., Chicago, Ill., U.S.A., model No. 82821C decade resistor), using a multimeter (Keithley, model 177). Each photocurrent value was recorded after a time lapse of three minutes when substantial steady state was reached. The corresponding electrolysis cell potentials were measured by attaching external copper wire leads, in direct contact with the back surface of the titanium/ruthenium dioxide and platinum electrocatalysts, to a Keithley multimeter. The photocurrents were varied by varying the value of a load resistor 310 in series with the electrolysis cell.

By varying the load resistor 310, it is possible simultaneiously to withdraw both chemical and electrical power from the cell. The maximum efficiences of solar energy conversion to hydrogen and electricity are 7.8 and 1% respectively as in FIG. 3. These values may be varied, by varying the value of the external resistance.

Figure 4:
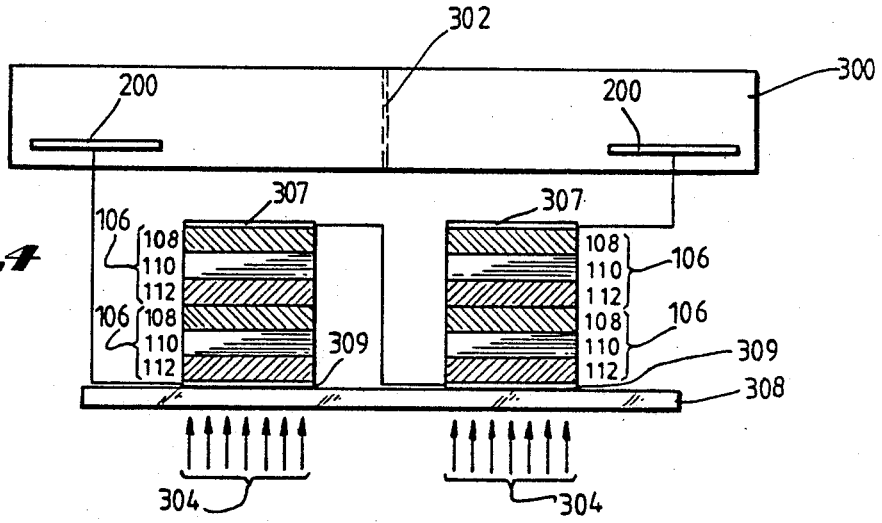
FIG. 4 is a schematic diagram of a (pin-pin)-(pin-pin) amorphous silicon-based one-unit photo-activated electrolyzer.

FIG. 4 is a schematic diagram of a one-unit photoactivated electrolyzer using amorphous silicon semiconductors 106. In this embodiment a stack of two amorphous silicon semiconductors 106 is connected in series with another stack of two amorphous silicon semiconductors. Each amorphous silicon semiconductor 106 consists of a n-type silicon layer 108 separated from a p-type silicon layer 112 by an intrinsic silicon layer 110. The amorphous silicon semiconductors 106 are stacked in such a manner that p-type silicon layers 112 contact n-type silicon layers 108. An aluminum ohmic contact layer 307 is located at the top of each stack. A transparent tin oxide ohmic contact layer 309 is located at the bottom of each stack. In this particular embodiment, tin oxide was coated on the glass support 308, and the semiconductors 106 placed on the tin oxide coated glass, thus providing electrical contact between the aluminum ohmic contact layer 306 of one cell stack and the tin oxide ohmic contact layer 307 of a neighboring cell stack. Electrocatalysts 200 are applied to the surfaces of the aluminum ohmic contact layers 307 not exposed to light. The electrocatalysts 200 are then placed in contact with electrolyte 300. A membrane 302 may be used to separate evolved gases.

Figure 5:
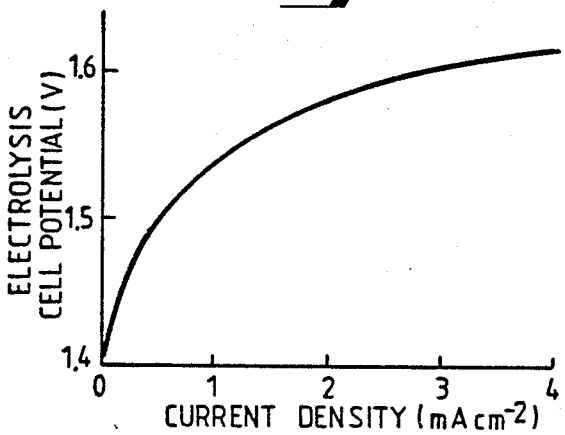
FIG. 5 is a graph referring to a particular embodiment of FIG. 4 and represents the variation of the electrolysis cell potential with the current density when the cell is irradiated by one sun of simulated solar irradiation at room temperature.
Figure 6:
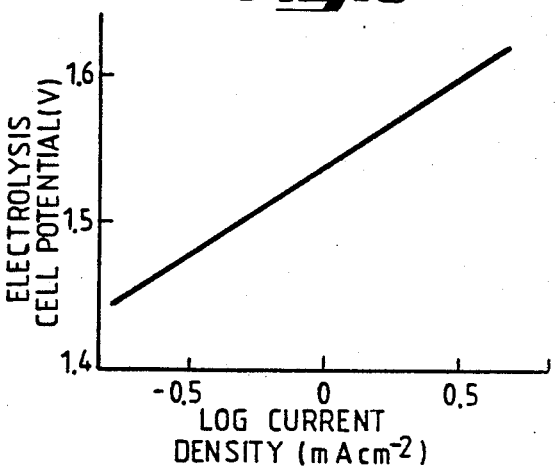
FIG. 6 is a graph referring to a particular embodiment of FIG. 4 and represents the electrolysis cell potential as a function of the log of the current density.
Figure 7:
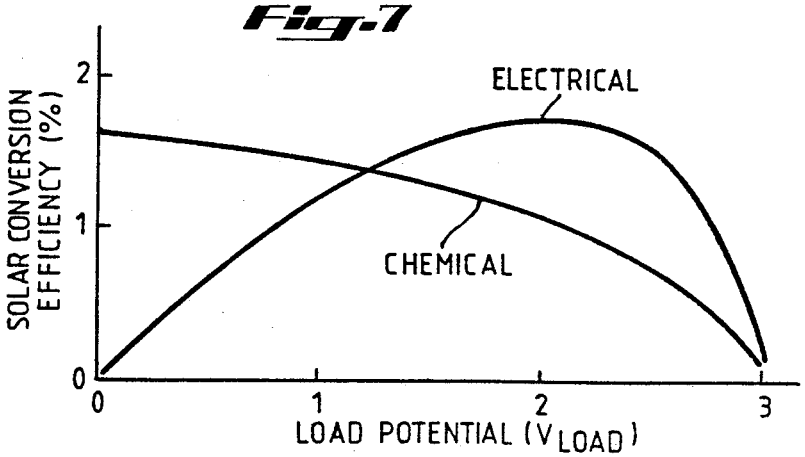
FIG. 7 is a graph referring to a particular embodiment of FIG. 4 and represents the variation of solar conversion efficiency to hydrogen as a function of load potential drop.

The embodiment depicted in FIG. 4 is for purposes of illustrating the system giving rise to the graphs of FIGS. 5–7. Two (pin-pin) cells, that is, two twin-stacked pin amorphous silicon photovoltaics, are connected in series along their length by means of overlapping Al metal deposits. Although only two stacks are illustrated titanium/ruthenium dioxide was coated on an Al strip in contact with the amorphous p-Si layer of the first cell, while Pt foil was placed over an Al strip in contact with the amorphous n-si layer of the second cell. These catalyst layers were exposed to the solution, the rest of the photovoltaic structure being isolated by means of inert epoxy cement.

For the photovoltaic electrolysis of water, a current density of about 4 milliamps per square centimeter can be readily obtained at an insolation of one sun as shown in FIG. 5.

FIG. 7 is the solar conversion efficiency as a function of load potential drop across a variable resistor placed in series with the photovoltaic electrolysis cell. It can be seen that the maximum solar energy conversion to hydrogen is 1.6% for the series arrangement of amorphous silicon photovoltaic cells while a conversion efficiency to electrical energy of 1.75% is obtained. A combined solar energy conversion efficiency of about 3% to electrical and chemical energy can be obtained.

Figure 8:
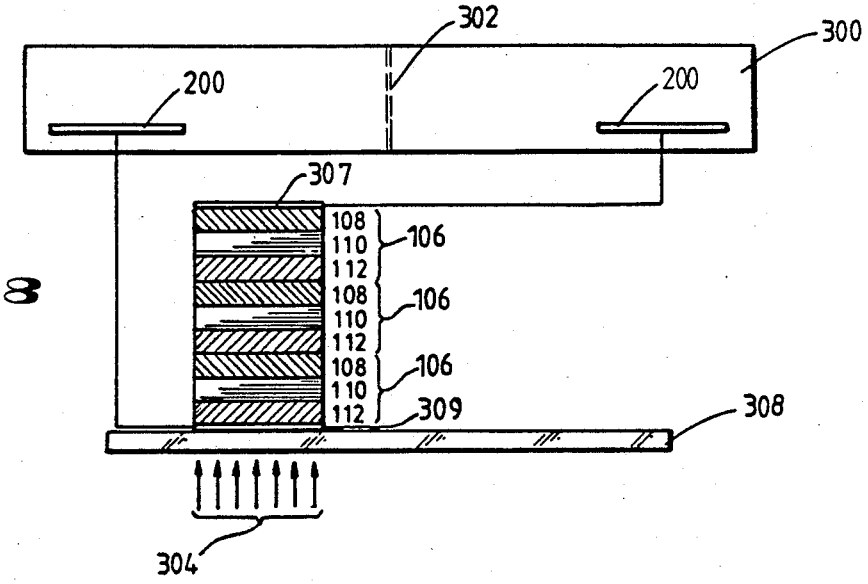
FIG. 8 is a schematic diagram of a (pin-pin-pin) amorphous silicon-based one-unit photo-activated electrolyzer.
Figure 9:
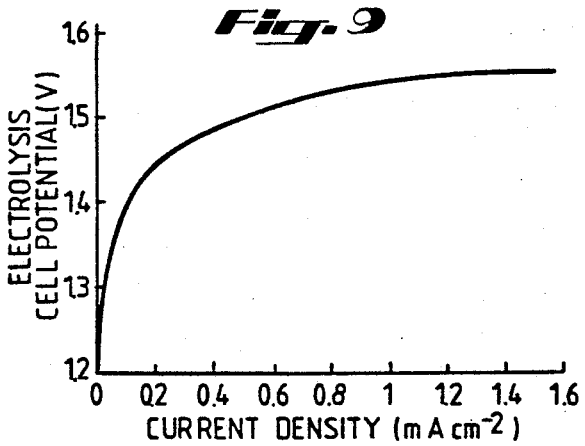
FIG. 9 is a graph referring to a particular embodiment of FIG. 8 and represents the variation of electrolysis cell potential with the current density when the cell is irradiated by one sun of simuated solar irradiation at room temperature.
Figure 10:
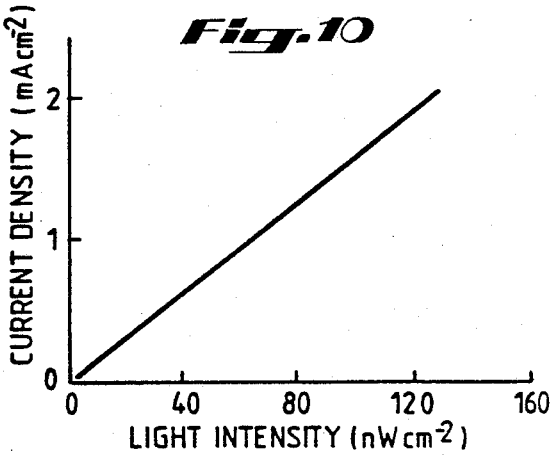
FIG. 10; is a graph referring to a particular embodiment of FIG. 8 and represents the variation of current density with light intensity when the cell is irradiated by simulated solar irradiation of various intensities.
Figure 11:
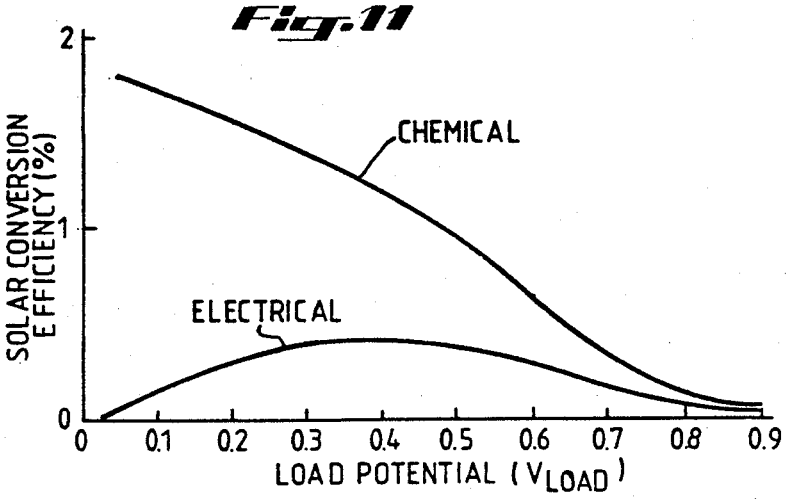
FIG. 11 is a graph referring to a particular embodiment of FIG. 8 and represents the variation of solar conversion efficiency to hydrogen as a function of load potential drop.

FIG. 8 depicts another embodiment of the subject invention similar to FIG. 4, except that the amorphous silicon photovoltaic cells 106 are three-stacked in the (pin-pin-pin) arrangement. FIGS. 9–11 refer to the embodiment of FIG. 8. As shown in FIG. 9, for the photovoltaic electrolysis of water, a current density of 1.5 milliamps can be obtained at an insolation of one sun. As seen in FIG. 10, the photocurrent density, or hydrogen evolution rate, increases linearly with light intensity up to 120 milliwatts per square centimeter. FIG. 11 is the solar conversion efficiency as a function of load potential drop across a variable resistor similar to FIGS. 3 and 7. The solar conversion to hydrogen is 1.8% and the solar conversion to electrical energy is 0.5%.

What is claimed is:

1. A method, comprising:

(a) engaging with an electrolytic solution contained in an electrochemical reaction zone an anode and a cathode, said anode and cathode being in physical and ohmic contact with a photo-activated semiconductor device having separate donor and acceptor regions external of the electrolytic solution, said anode being contacted with the acceptor region and said cathode being contacted with the donor region; and (b) exposing at least a portion of said photo-activated semiconductor device external of said electrolytic solution to a source of radiation.

2. A method, comprising:

(a) engaging with an electrolytic solution contained in an electrochemical reaction zone an electrocatalyst which is in physical and ohmic contact with a first surface of a photo-activated semiconductor device; and (b) irradiating with light energy a second surface of said photo-activated semiconductor device external of the electrolytic solution.

3. The method of claim 2, wherein said semiconductor device comprises amorphous silicon or gallium arsenide.

4. The method of claim 2, wherein said semiconductor device comprises a stack of two or more amorphous silicon semiconductors connected for creating a potential therein.

* * * * *